United States Patent [19]

Flieger

[11] 4,260,967

[45] Apr. 7, 1981

[54] HIGH POWER WAVEGUIDE FILTER

[75] Inventor: Howard W. Flieger, Bethesda, Md.

[73] Assignee: Communications Satellite Corporation, Washington, D.C.

[21] Appl. No.: 23,991

[22] Filed: Mar. 26, 1979

[51] Int. Cl.[3] ..... H01P 1/207

[52] U.S. Cl. ..... 333/208; 333/212; 333/229

[58] Field of Search ..... 333/21 A, 208, 209, 333/212, 229, 234

[56] References Cited

U.S. PATENT DOCUMENTS

| | | | |
|---|---|---|---|
| 2,996,690 | 8/1961 | St. Clair | 333/229 |
| 3,063,030 | 11/1962 | Manahan et al. | 333/229 |
| 3,697,898 | 10/1972 | Blachier et al. | 333/21 A |
| 4,156,860 | 5/1979 | Atia et al. | 333/229 |

*Primary Examiner*—Eugene R. LaRoche

*Attorney, Agent, or Firm*—Sughrue, Rothwell, Mion, Zinn and Macpeak

[57] ABSTRACT

A waveguide filter capable of operating at high power levels while retaining substantially constant filter characteristics over a wide temperature range. Two cylindrical body portions of a metal having a low temperature coefficient expansion are sandwiched between three highly thermally conducting iris members, each of which has an aperture of predetermined dimensions for determining the wave modes which propagate through the filter. Each iris member extends beyond the adjacent bodied portion to heat dissipating means which may either be cooling fins through which air is circulated or cooling coils through which a cooling fluid is circulated. Because the proportion of the total filter length occupied by the iris members is much smaller than that of the body portion, very little elongation takes place as the filter cavity is heated thus resulting in temperature-stable filter characteristics.

18 Claims, 4 Drawing Figures

HIGH POWER WAVEGUIDE FILTER

BACKGROUND OF THE INVENTION

The invention pertains to wave guide filters such as may used in filtering the output of a high-power RF microwave-frequency transmitter for eliminating undesirable out-of-band frequencies and spurious modes. U.S. Pat. No. 3,697,898 issued on Oct. 10, 1972, to Blachier et al and assigned in common with the present application, discloses a plural cavity bandpass waveguide filter device having two cascaded double-tuned cavities which are resonant in two independent orthogonal modes so as to provide thereby a bandpass response. The device there described is constructed as a closed cylindrical cavity having a direct-coupling iris positioned orthogonally in the center of the cavity for selectively coupling identical resonant modes between the two adjacent cavities separated from one another by the iris. Input and output iris members are positioned at the extremities of the cavity for coupling in and out waves having the desired polarization and mode state. In each cavity, one or more adjustable tuning screws which extended through the cylindrical cavity walls are provided for further wave mode adjustment.

Because of the high power levels produced by many present-day microwave transmitters, relatively large amounts of heat were necessarily dissipated in the filter device due to the elimination of unwanted cavity modes. This heat dissipation in trun gave rise to a relatively large temperature increase in the device, which, if the usual highly conductive metals such as copper were used in the construction of the device, would cause the walls to expand when heated by such an amount as to detune the device. The device thus was not readily usable at high power levels such as one kilowatt or more.

In order to avoid the detuning of the filter characteristics, the filter was constructed of a metal material such as Invar which has a low thermal coefficient of expansion. Unfortunately, materials which have a low coefficient of expansion also generally have a low electrical conductivity. For this reason, to avoid resistive losses which would otherwise occur between filter sections, it was usually necessary to fabricate the filter device as an integral unit machined from a single segment of bar stock. This of course made such devices quite costly as it is difficult to form the iris member in the center of the cylindrical cavity with the dimensional tolerances required for typical filter applications. Also, even though a material having a low temperature coefficient of expansion was utilized, the total power which the device could handle was nonetheless limited because of the generally poor thermal and electrical conductivity of the low temperature coefficient of the expansion material.

That is, heat which was generated at the irises flowed into the lateral walls heating them and causing them to expand lengthwise. Because of the low thermal conductivity of the walls, the heat present therein could not be extracted at a desirable rate. Accordingly, if it were desired to couple a very high power transmitter to an antenna using such a filter device, it was necessary first to split the transmitter output into a number of parallel, equal-phase branches and then couple each branch through a separate device, then to recombine the output signals from all the devices prior to coupling the filtered output to the antenna. The cost of multiple filter devices of course increased the overall cost of this system from what it would be had only a single filter device been necessary.

SUMMARY OF THE INVENTION

Accordingly, it is an object of the present invention to provide a waveguide filter device of the above-described type which is capable of operating at high power levels.

Also, it is an object of the present invention to provide such a waveguide filter device which has essentially stable filter characteristics over a broad temperature and power range.

Furthermore, it is an object of the present invention to provide such a filter device which is inexpensive and relatively easy to construct and which does not require difficult machining steps.

These, as well as other objects of the invention may be met by providing a waveguide filter device which includes the combination of a filter body of a material having a low thermal coefficient of expansion and a plurality of iris means, one of which is positioned at each end of the filter body, the iris means being of a different material than the filter body and having a high thermal conductivity. In the preferred embodiment, the filter body includes a plurality of sections with one of the iris means positioned adjacent each end of each of the sections with one of the iris means positioned between the two sections. The iris means extend at least to the periphery of the filter body and means for extracting heat is coupled to each of the iris means. The heat extracting means many comprise cooling fins or cooling coils including means for circulating cooling fluid in thermal contact with the iris means.

The central portion of each of the iris means is formed from a plate of a material of high thermal conductivity and preferably high electrical conductivity wherein each has an aperture of predetermined dimensions chosen in accordance with the preferred filtering characteristics of the device. Each aperture is positioned laterally adjacent the opening through the adjacent body portions. Also, there may be provided one or more variable position tuning screws or stubs, which are operatively connected to one or more of the sections of the body portion and which extend through the walls thereof. In the preferred embodiment, the body portion, or both sections of the body portion, are substantially circular in internal cross section thereby defining a substantial cylindrical body cavity. A conductive coating may be provided on the internal surfaces of the cavity including, if desired, the iris members. The body portion may comprise an alloy of iron and nickel in proportions so as to provide low thermal expansion characteristics, while the iris means each comprise a highly thermally and electrically conductive material such as copper, silver, aluminum, or the like. The plates forming the iris means members may be attached to the adjoining body portions through screw fasterners or alternatively by soldering or brazing.

DESCRIPTION OF THE PREFERRED EMBODIMENTS

Figure 1:
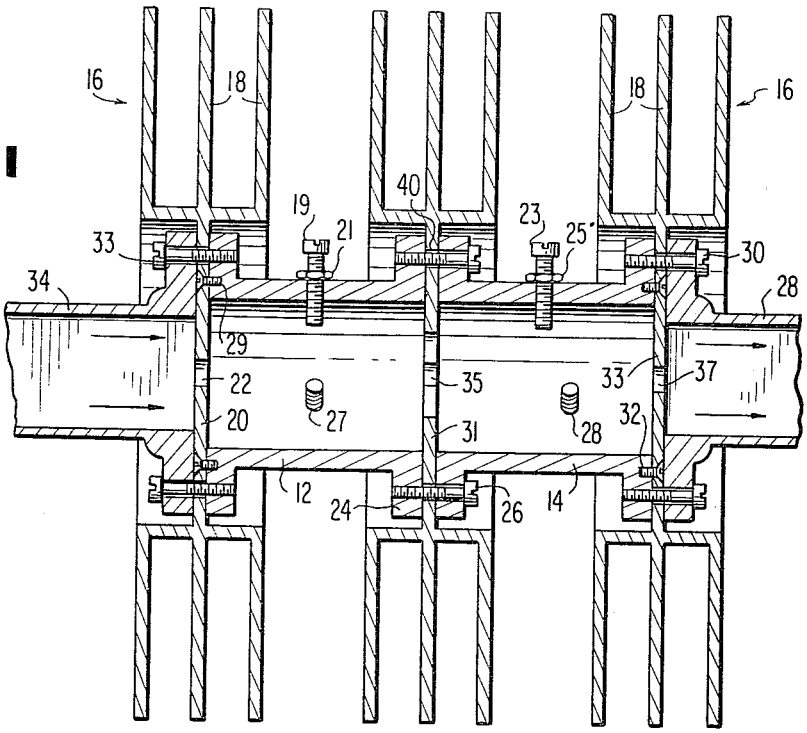
FIG. 1 shows a cross-sectional view through a filter device constructed in accordance with the teaching of the present invention.

Referring first to FIG. 1, a device constructed in accordance with the teachings of the present invention is shown therein in cross section. The device includes a body portion having first and second body sections 12 and 14 joined together through iris member 31. Each body portion 12 and 14 includes an internal substantially cylindrical chamber having dimensions determined in accordance with the frequencies and bandpass characteristics desired for the particular filter application at hand. Both body sections 12 and 14 are constructed of a metal material such as Invar®, which has a low thermal coefficient of expansion over at least a predetermined range of temperatures and consists essentially of an alloy or iron and nickel containing approximately 36% nickel.

First and second body sections 12 and 14 are joined to one another through iris member 31 by screws 26. At the other end the first and second body sections 12 and 14, there are positioned second and third iris members 20 and 33, respectively, which are joined to body sections 12 and 14 respectively with flat heat screws 29 and 32. Each of iris members 20, 31 and 33 is constructed of a material having both a high thermal and a high electrical conductivity. In accordance with the invention, each of iris members 20, 31 and 33 extends beyond the outer peripheral edge of the adjoining body sections 12 and 14.

At the left end of the device as shown in FIG. 1, an input waveguide 34 is joined to iris member 20 by screws 33. At the right-hand side of the device, an output waveguide 28 is secured to iris member 33 by screws 30. Both input waveguide 34 and output waveguide 28 may have a different cross section and be of a different shape than the internal cavities formed by body sections 12 and 14. They may, for example, be rectangular in cross section.

A number of adjustable tuning screws or stubs, 19, 23, 27 and 28, may be provided for further adjustment of the internal wave characteristics. These may each be formed as a screw made of a metal material with each extending through a threaded aperture in one of sections 12 and 14. Nuts, such as those shown at 21 and 25, may be provided for holding the screws securely in place once they have been set at the correct depth.

Each of iris members 20, 31 and 33 is thermally coupled to one of cooling fin members 16. As shown in FIG. 1, iris members 20, 31 and 33 are formed integrally with cooling fins 16. Alternatively, iris members 20, 31 and 33 can be made to extend beyond the peripheral edge of body sections 12 and 14 with separately constructed cooling fins coupled to the flange formed by the extension of the iris members. As shown in FIG. 1, three fins 18 are provided on each cooling fin 16, although a different number, depending upon the amount of heat to be dissipated could be provided as desired. Means, not shown, for circulating air past cooling fins 16 can also be provided. Still further, cooling fins 16 can be coated with a material such as black paint which increases the heat radiation properties of the cooling fins 16. If separatelyconstructed cooling fins 16 are provided, they may be attached to iris members, 20, 31 and 33 either by fastening means such as screws or by soldering or brazing, depending upon the material employed. Preferably, both irises 20, 31 and 33 and cooling fins 16 are constructed of a highly thermally and electrically conductive material such as copper, silver, aluminum or the like.

Figure 2:
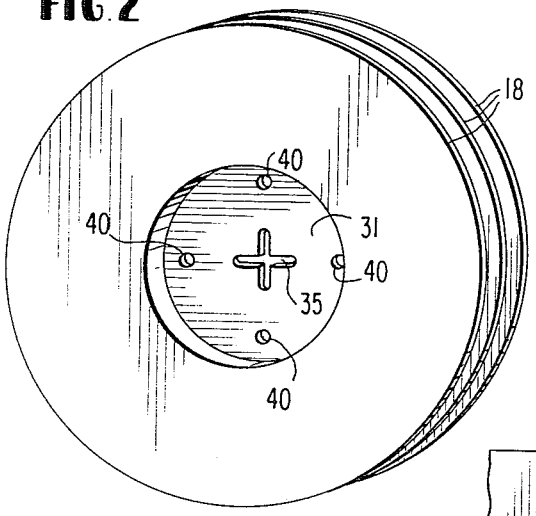
FIG. 2 shows a perspective view of one of the iris members of the device of FIG. 1.
Figure 3:
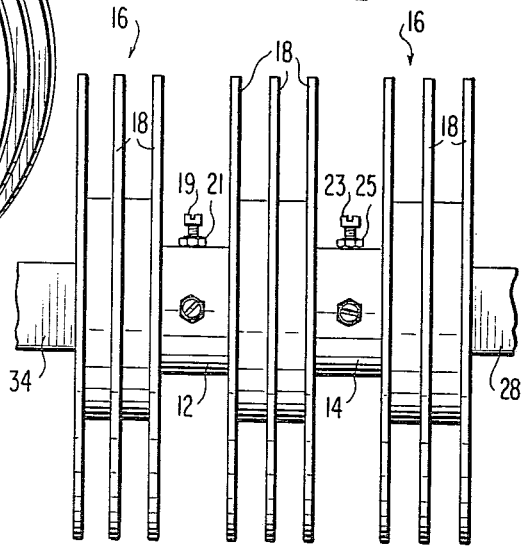
FIG. 3 is a plan view of the device shown in FIG. 1.

Iris member 31 is shown in perspective view in FIG. 2. Therein it may be seen that each of cooling fins 18 has a generally annular shape, although other shapes may be used as well depending upon the space where the filter is to be mounted. As shown in FIG. 2 and as described in referenced U.S. Pat. No. 3,697,898, aperture 35 in iris 31 has a generally "plus sign" shape in which the exact dimensions are determined in accordance with the desired filter frequency characteristics. Apertures 22 and 37 in iris members 20 and 33, as described in the referenced patent, have a simple longitudinal slit shape. Holes 40 are provided for receiving the mounting screws.

Operationally, the basic electrical operation except for the temperature dependence is the same as that described in the above-referenced U.S. patent. However, thermally, the device described here exhibits a much different behavior. Heat dissipated in iris members 20, 31 and 33 flows directly and rapidly outwardly to cooling fins 16 where the internally generated heat is dissipated to the surrounding air. Because the thermal conductivity of the iris members is substantially greater than that of body sections 12 and 14, substantially all of the heat generated internally upon iris members 20, 31 and 33 is conducted to the various cooling fins with very little passing into body sections 12 and 14. Thus, for a given level of input power, the heat flowing into the lateral walls of the filter device is much smaller with the structure of the present invention than in the prior art devices. Accordingly, as iris members 20, 31, and 33 account for only a relatively small fraction of the total length of device, the elongation of the device, caused by thermal expansion, is much smaller with the device of the invention, as contrasted with the prior art devices.

Moreover, as may be readily appreciated, the filter device of the present invention is far simpler to construct than the prior art device as no special machining techniques are required to form the center iris. Instead, the iris members as used with the present invention can be separately and easily constructed prior to assembly of the composite.

As far smaller dimensional changes are produced with the device constructed with the invention than with the prior art devices, the power handling capabilities of a device of the present invention for a given amount of allowable detuning are considerably increased. In many situations where multiple filter devices were previously required, a single device of the invention may be substituted thereby significantly decreasing the overall system cost.

Figure 4:
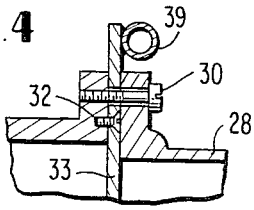
FIG. 4 is a cross-sectional view showing an alternative embodiment of a portion of the device shown in FIG. 1.

An alternative embodiment is shown in the cross sectional view of FIG. 4. In this view, which shows only the region at the upper part of iris number 33 in the vicinity of the upper portion of body section 14 at the juncture with output waveguide 28, cooling fins 16 have been replaced by a cooling coil 39. In this embodiment, iris member 33 extends in the form of a flange beyond the outer edges of body section 14 and output waveguide 28. A cooling tube 39 through which a cooling fluid is circulated from an external source, not shown, is brazed or soldered to the side of the flange formed by the outer periphery of iris member 33. This embodiment is preferred in situations in which only a limited amount of space is available for the filter device.

This completes the description of the preferred embodiments of the invention. Although preferred embodiments have been described, it is believed that numerous modifications and alternations thereto would be apparent to one having ordinary skill in the art without departing from the spirit and scope of the invention.

I claim:

1. A waveguide filter comprising:

(a) a filter body of a material having a low thermal coefficient of expansion; and (b) a plurality of iris means, one of said iris means being positioned adjacent each end of said filter body, said iris means being of a material having a high thermal conductivity such that substantially all the heat generated in the iris is conducted away from the iris by the high thermal conductivity material and little of said heat is transferred into said filter body.

2. The waveguide filter of claim 1, wherein said filter body comprises a plurality of sections, one of said iris means being positioned adjacent each end of each of said sections.

3. The waveguide filter of claim 1 further comprising means for extracting heat from said iris means.

4. The waveguide filter of claim 3 wherein said heat extracting mean comprises cooling fins thermally coupled to said iris means.

5. The waveguide filter of claim 3 wherein said heat extracting means comprises means for circulating cooling fluid in thermal contact with said iris means.

6. A waveguide filter comprising:

(a) a body portion, said body portion comprising a plurality of sections, each of said sections being of a material having a low thermal coefficient of expansion, and (b) a plurality of iris means, one of said iris means being positioned adjacent each end of each of said sections, each of said iris means comprising a plate of a material of high thermal conductivity, each of said iris means having an aperture therein of predetermined dimensions, said aperture being positioned laterally adjacent an opening through an adjacent body section and each of said iris means extending at least to the outer edges of adjacent body sections substantially all the heat generated about each aperture being conducted away from the aperture by the high thermal conductivity material and little of said heat being transfered into said section.

7. The waveguide filter of claim 6 furhter comprising cooling fin means thermally coupled to each of said iris means.

8. The waveguide filter of claim 6 further comprising means for passing a cooling fluid in thermal contact with said iris means.

9. The waveguide filter of any of claims 6–8 further comprising at least one variable position tuning stub means operatively coupled to at least one of said sections of said body portion.

10. The waveguide filter of any of claims 6–8 wherein said body portion has a substantially circular internal cross section.

11. The waveguide filter of any of claims 6–8 wherein said body portion comprises an electrically conductive coating on the internal surfaces thereof.

12. The waveguide filter of any of claims 6–8 wherein said body portion comprises an alloy of iron and nickel.

13. The waveguide filter of any of claims 6–8 wherein said iris means comprises a material selected from the group consisting of copper, silver and aluminum.

14. A waveguide filter comprising in combination:

(a) a body portion having first and second sections, each of said sections defining an inner, generally cylindrical cavity, each of said sections comprising a metal material having a low thermal coefficient of expansion, and each of said sections comprising a coating of a metal having a high electrical conductivity on the walls of said inner cylindrical cavity;

(b) first second and third iris members, said first iris member being positioned at a first end of said first one of said sections of said body portion, said second iris member being positioned between a second end of said first one of said sections and a first end of the second one of said sections, and said third iris member being positioned at a second end of said second one of said sections, each of said irises comprising a plate of material having a high thermal conductivity and each having an aperture therein of predetermined dimensions for determining wave modes within said filter, each of said iris members extending beyond the outer edges of said body portion; and (c) a plurality of sets of cooling fins, one of said sets of cooling fins being thermally coupled to one of said iris members.

15. The waveguide filter of claim 14 wherein said body portion comprises an alloy of iron and nickel.

16. The waveguide filter of claim 14 wherein said iris members comprise a material selected from the group consisting of copper, silver and aluminum.

17. The waveguide filter of claim 14 further comprising a coating of a metal having a high electrical conductivity on portions of said iris members adjacent the inner cylindrical cavities formed by said sections of said body portion.

18. The waveguide filter of any of claims 14–16 further comprising means for passing air through said cooling fins.

* * * * *